United States Patent [19]

Kuykendall

[11] Patent Number: 4,795,158

[45] Date of Patent: Jan. 3, 1989

[54] GOLF PUTTER

[75] Inventor: Jacob E. Kuykendall, Hoffman Estates, Ill.

[73] Assignee: Right Way Golf, Hoffman Estates, Ill.

[21] Appl. No.: 28,492

[22] Filed: Mar. 20, 1987

[51] Int. Cl.[4] ..... A63B 53/04; A63B 53/14

[52] U.S. Cl. ..... 273/164; 273/168; 273/171; 273/81 B; 273/167 B

[58] Field of Search ..... 273/171, 80 C, 81 B, 273/167 B, 168, 167 G, 167 J, 167 K, 175, 81 R, 81 A, 169, 170, 172; D21/218, 217, 219

[56] References Cited

U.S. PATENT DOCUMENTS 2,517,245 8/1950 Scott ..... 273/171

3,819,180 6/1974 Murphy ..... 273/80 C 4,537,403 8/1985 Farina ..... 273/81 B

FOREIGN PATENT DOCUMENTS 7550 of 1900 United Kingdom ..... 273/167 B 20882 of 1908 United Kingdom ..... 273/81 B

*Primary Examiner*—George J. Marlo

*Attorney, Agent, or Firm*—Wallenstein Wagner Hattis & Strampel, Ltd.

[57] ABSTRACT

A golf putter comprising a putter blade or head having a forwardly-angled striking face to impart immediate overspin to the ball being struck and said putter further including a relatively large square handle or grip for enabling alignment of the palm of the hand with the projected line of ball travel.

4 Claims, 1 Drawing Sheet

FIG. 1
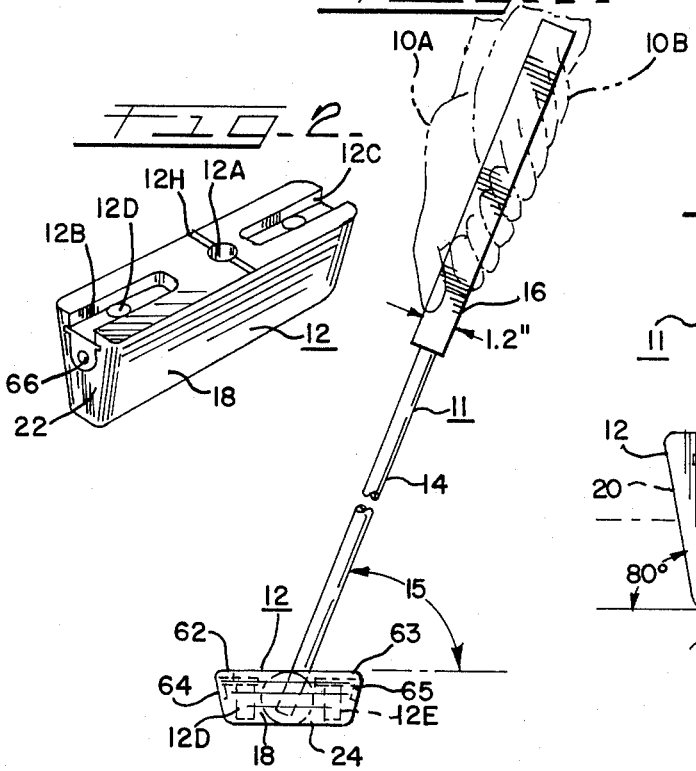
FIG. 2
FIG. 3
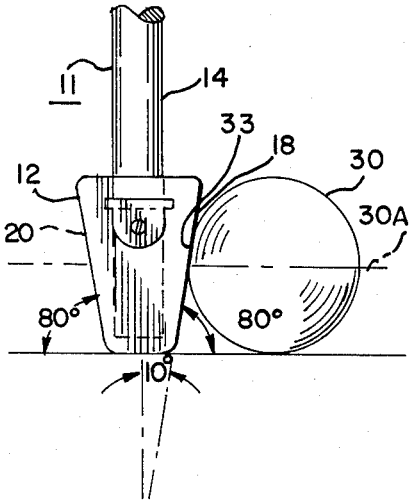
FIG. 4
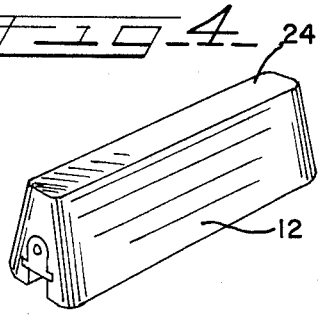
FIG. 6
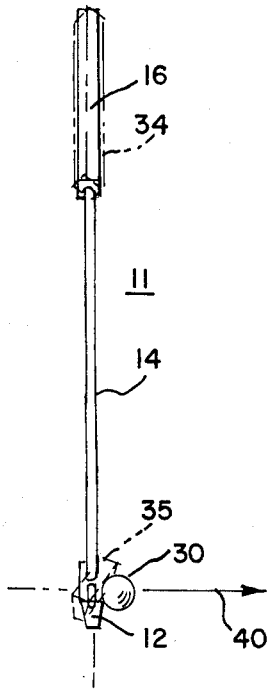
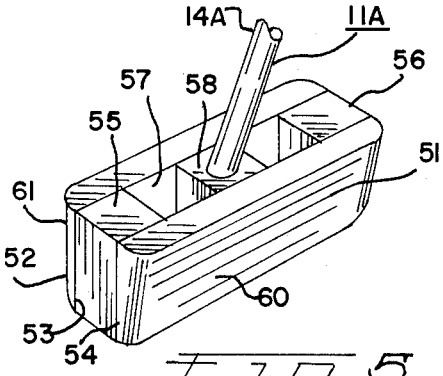
FIG. 5

GOLF PUTTER

BACKGROUND OF THE INVENTION

A number of studies have been made and theories advanced concerning the principles involved in accurately putting a golf ball. Also, there is an endless variety of putters having various types of heads or blades and various types of shafts. A great variety of putters have been produced for improving the alignment of the putter with the projected line of movement of the ball. Such putters have included gun sights, mirror arrangements, cross-hairs, etc. Other putters have included weighted means for compensating for the twist of the club due to impact with the ball. Further, mathematical analyses have been provided to show the mechanics of good putting. All the foregoing has been done because it is recognized that putting involves a complex physical skill, and it is desirable to provide means to enable the golfer to become more skilled in the art of putting.

The following patents represent prior art of interest known to applicant:

U.S. Pat. No. 4,067,573 to Key, Jr. entitled "Putter Hand Grip"; U.S. Pat. No. 4,077,633 to Studen entitled "Golf Putter"; U.S Pat. No. 4,162,074 to Thomson entitled "Golf Putter"; U.S. Pat. No. 4,215,860 to Nakamatsu entitled "Golf Club"; and U.S. Pat. No. 4,272,077 to Spivey entitled "Golf Club Putter Grip".

U.S. Pat. Nos. 4,067,573 and 4,272,077 show enlarged grips to improve putter grip; U.S. Pat. No. 4,162,074 shows a golf putter blade having a complex curve to impart overspin to the ball. U.S. Pat. No. 4,077,633 shows a putter having an inclined surface terminating in a horizontal point or line of somewhat lesser height than the diameter of the ball for contacting the ball.

As will be explained hereinafter, applicant provides a flat forwardly inclined surface to assure overspin is provided to the ball.

U.S. Pat. No. 4,215,860 discloses a golf putter having a large square grip apparently at least two inches in width, wherein the putter is used by placing the thumbs parallel, and side by side on the grip. The grip is relatively large and apparently must be used with the hands at the same height on the shaft. It appears the putter could not be used with the hands positioned one above the other as is normal usage.

While the applicant recognizes that putting requires certain skills, the present invention suggests certain unique principles and provides a putter having certain unique features which enables the golfer to maximize his ability to align and properly stroke the ball toward the hole.

SUMMARY OF THE INVENTION

The present invention relates to an improved golf putter comprising a blade or head having a forwardly-inclined surface to assure that as the blade strikes the ball, it imparts an immediate overspin to the all, and further the putter includes a large square handle or grip which enables the golfer to align the palm of the right hand, the back of the left hand, and the club face with the projected line of movement or travel of the ball.

DESCRIPTION of THE DRAWINGS

FIG. 1 is a side view of the inventive putter;

FIG. 2 is an isometric view of the head or blade of the putter of FIG. 1;

FIG. 3 is an end view of the head or blade and shaft of the putter of FIG. 1 showing the inclined striking face of the putter;

FIG. 4 is an isometric view of a second embodiment of the head or blade of FIG. 1 in a reverse or upside down position to show the large flat area, for proper soling, of the bottom of the blade;

FIG. 5 is an isometric view of another embodiment of the head or blade of the inventive putter including spaced face plates mounted to straddle the putter shaft; and FIG. 6 is a view to show the rectangular cross sectional shape of the grip of the putter of FIG. 1 and with dotted lines useful in explaining the alignment of the putter hereinafter.

DESCRIPTION OF THE INVENTION

Refer now to FIGS. 1, 2, 3 and 6. FIG. 1 shows the inventive golf putter 11. Putter 11 includes a head 12, a shaft 14 and a grip or handle 16. Note that the invention is applicable to a putter head which is either of a mallet type or a blade type, and the important feature of the putter head in the present invention is the structure of the ball-striking surface of the putter head. In the following description, the term blade is used, as this is the type of head shown in the drawings. FIGS. 2 and 3 show the structure of the blade 12.

The height or length of shaft 14 can be of different selected lengths. Also, the shaft ca be positioned at different specific angles to adjust to short, medium, or tall golfers. The shaft will be set in the factory between 10 degrees and 30 degrees to adjust the putter to the player's height and physical characteristics. A typical length of shaft, including the grip, is thirty-six inches (36").

As shown in FIG. 2, blade 12 includes a central bore **12*a* for receiving the end of shaft 14. In the embodiment shown, the blade 12 is about 5 inches in length and 1.75 inches in height, and comprises a frustoconical structure 22 with the large top being about 1.25 inches wide and the more narrow bottom edge sole 24 of the structure 22 being about 0.75 inches wide. The sole 24 will rest on the ground or green when the putter 11 is to be used. In side view, the blade 12 comprises a rectangular member, best seen in FIG. 1. For purposes of this description, the use of the putter 11 by a right-hand golfer is assumed. It is an important and a basic concept of the invention that the striking face 18 of the blade 12 be angled to form an acute angle with a horizontal surface in which the ball 30** is resting. This feature will be explained more fully hereinbelow.

The reverse face 20 of blade 12 may be of any suitable design; however, if the reverse face 20 is angled similarly as the striking face 18, the putter 11 is more symmetrical in design and in weight or balance. Also, a symmetrical putter is adapted to be used either by a right-handed or left-handed golfer.

Refer now more specifically to FIG. 3 for a more detailed discussion of important features of the invention. FIG. 3 shows the blade 12 of the inventive putter 11 positioned and aligned to strike a golf ball 30. Importantly, the angled striking face 18 of the blade 12 contacts the ball 30 above the diametrical center 30A of the ball. This assures that the ball 30 receives an immediate overspin propelling force to assure that the ball immediately starts a rolling action toward the golf hole. Hence, the ball is not slid or skidded forward; rather a smooth, direct and true forward roll of the golf ball 30 is achieved.

More specifically, the striking face 18 of blade 12 is angled toward the ball about ten degrees (10°). As mentioned, the height of the blade is 1.75 inches, and this combination of angle and height produces an impact of the blade 12 above the center line 30A of the ball as at point 33 in FIG. 3.

As can be appreciated from FIG. 3, the forwardly-inclined striking face 18 of blade 12 assures face 18 will strike the ball above the center 30A of the ball. It is virtually impossible to strike the ball below the center 30A of the ball 30. This above-center impact produces immediate overspin on the ball.

Refer now also to FIG. 6 for other important features of the invention. As mentioned above, the grip or handle 16 of putter 11 is approximately a minimum of ten inches (10") in length and rectangular in cross section and preferably square and less than 1.75 inches on the side. In the preferred embodiment, the grip or handle 16 is 1.2 inches square, as indicated in FIG. 1. This relatively long and large grip 16 allows the golfer to align the palm of the right hand 10A and the back of the left hand 10B with the striking face 18 of the blade to assist and aid the alignment of the putter 11 at right angles with the projected line, or movement 40 of the ball 30. Further, because of the rectangular configuration of the blade and the handle, the golfer can feel, and view, that the palm of one hand and the back of the other hand, and the blade 12 are in fact "square", that is, at right angles to the projected line of movement. Any misalignment is readily apparent, as indicated by the dotted lines 34 and 35 in FIG. 6.

As will be appreciated, parallel lines on the top of the blade and the vertical lines of the grip 16 are at right angles with each other and all these lines should be at right angles with the projected line of travel of the ball 30.

As best seen in FIG. 2, the shaft 14 is received in aperture 12A, which is centrally located in blade 12. There is no off-line twisting due to the impact of blade 12 with the ball 30, since the blade 12 strikes the ball 30 at the point where shaft 14 is affixed to the blade. The direction of the force applied to the ball is directly on the center line of the force applied to the club shaft. This allows the flat right hand palm to apply a single directional force to the shaft with no twisting action of the club head.

Many current putters have the shaft positioned toward the back or heel of the putter. Whenever a ball is struck with a putter where the shaft is not directly in line with the ball, the ball creates a force which twists the club in the opposite direction of the force. This means that a player is always subconsciously rotating the hands and/or increasing muscular grip to compensate for the reverse rotation created by the ball.

Alignment of the inventive putter 11 tends to be more exact. The parallel lines 12H on the top of the head or blade 12 assists in aligning the blade 12 on the ball 30. When the head or blade 12 is exactly square to the direction of the line of travel of the ball and the player is positioned correctly, the shaft 14 and the putter head 12 are directly in line with each other, with the ball and with the line of travel. Any tilting or twisting of the putter head, and the direction of the tilting or twisting, is readily apparent.

As mentioned above, the palm of the right hand 10A is aligned with the face 18 when the palm is wrapped around the grip due to the large square handle or grip 16. This is an important feature in the ability to sink putts. Because the palm of the hand and the face are parallel, the mechanics of putting can be removed from the thought process and replaced with the important image of pushing the palm toward the hole. Because the handle is square, there is only one way to effectively place the hands on the putter to produce proper ball direction. The right palm is placed against the flat backside of the grip and the left hand palm is placed against the flat front side of the grip. This places the direction of the force by the hands exactly orthogonal to the flat front and back surfaces of the grip. This alignment aid makes for consistent stroke repeatability.

FIG. 2 shows the blade with elongated recesses 12B and 12C formed in the top of the blade 12. Weight retaining holes 12D and 12E extend downwardly from recesses 12B and 12C and are adapted to receive weighting metal. Suitable recess covers 62 and 63 can be affixed to the putter 11 by suitable fasteners 64 and 65 received by threaded holes 66 and 67 in the putter head 12.

Note that as shown in FIGS. 3, 4, and 6 that the relatively large, flat bottom surface or sole 24 of the putter blade 12 provides a means of flatly basing or soling the putter on the green. As mentioned above, the putter bottom or sole 24 is five inches long and 0.75 inches wide. The sole 24 of the putter blade 12 will rest parallel to the ground or green and will tend to cause the putter to strike the ball in the same place each time. In contrast, consistent soling of putters with curved bottoms in the same position is difficult.

FIG. 5 shows another embodiment of the inventive putter wherein the putter blade 12 comprises a pair of striking plates 51 and 52. The striking plates 51 and 52 each have a flat face 53 and 54 affixed to spacer members 55 and 56 to provide a center channel 57 for receiving the putter shaft 14 which is affixed to the flat faces 53 and 54 of the plates 51 and 52 by a square collar 58. The outer or ball-striking surfaces 60 and 61 of each of the plates 51 and 52 is inclined at the same angle as the blade 12 as depicted in FIG. 3. The function of the putter 11A is similar to that of putter 11 of FIGS. 1-5.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

I claim:

1. A golf putter for putting a golf ball comprising in combination a generally rectangular putter head, a shaft and a grip, said shaft being affixed to the center of said head and having at least one striking face, said striking face being forwardly inclined with its upper edge forwardmost to form a continuous flat acute angle for engaging the ball above its center to produce overspin, said head having a flat planar lower surface, said grip formed adjacent the opposite end of said shaft, and said grip being substantially square and having four surfaces that are less than 1.75 inches in width, said grip having opposed surfaces extending generally parallel with said striking face, said opposed surfaces being respectively engaged by the palms of a user's hands to thereby aid in the alignment of the palm of one hand and the back of the other hand with said striking face to be substantially normal to the projected line of travel of the golf ball.

2. A golf putter as defined in claim 1, in which said head has a second opposed inclined striking face with an upper edge located rearwardly of a lower edge.

3. A golf putter as defined in claim 2, in which said striking faces are inclined to the vertical by about 10°.

4. A golf putter as defined in claim 1, in which said grip surfaces have a width of about 1.2 inches.

* * * * *